US011247257B2

(12) United States Patent
Glueck et al.

(10) Patent No.: US 11,247,257 B2
(45) Date of Patent: Feb. 15, 2022

(54) METHOD AND DEVICE FOR MACHINING AND/OR PRODUCING A COMPONENT AND SUCH A COMPONENT

(71) Applicant: Bayerische Motoren Werke Aktiengesellschaft, Munich (DE)

(72) Inventors: Bernhard Glueck, Fuerstenfeldbruck (DE); Robert Kirschner, Olching (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 47 days.

(21) Appl. No.: 16/050,723

(22) Filed: Jul. 31, 2018

(65) Prior Publication Data

US 2018/0333761 A1 Nov. 22, 2018

Related U.S. Application Data

(63) Continuation of application No. PCT/EP2017/051872, filed on Jan. 30, 2017.

(30) Foreign Application Priority Data

Feb. 1, 2016 (DE) ..... 10 2016 201 433.1

(51) Int. Cl.
*B21D 28/26* (2006.01)
*B21D 35/00* (2006.01)

(52) U.S. Cl.
CPC ..... *B21D 28/26* (2013.01); *B21D 35/001* (2013.01)

(58) Field of Classification Search
CPC ..... B21D 28/24; B21D 28/26; B21D 28/265; B21D 35/00; B21D 35/001; B21B 15/00; B21B 15/0007; B21B 15/0014
(Continued)

(56) References Cited

U.S. PATENT DOCUMENTS 3,166,827 A * 1/1965 Bushi ..... B21K 1/06 29/898.066
4,041,821 A * 8/1977 Gaiter ..... B23D 15/005 83/382

(Continued)

FOREIGN PATENT DOCUMENTS

CN 1199354 A 11/1998
CN 101203974 A 6/2008

(Continued)

OTHER PUBLICATIONS https://dictionary.cambridge.org/us/dictionary/english/stamping (Year: 2020).*

(Continued)

*Primary Examiner* — Sean M Michalski
*Assistant Examiner* — Richard D Crosby, Jr.
(74) *Attorney, Agent, or Firm* — Crowell & Moring LLP

(57) ABSTRACT

A method for machining includes providing a component or a semifinished part which has a main body with a first surface and with a first surface coating provided on the first surface. The method also includes notching the component or the semifinished part on the first surface coated with the first surface coating. The method also includes severing, perforating or trimming the component or the semifinished part along the notch. At least a part of the first surface coating which is notched in the process is maintained along notch surfaces.

21 Claims, 2 Drawing Sheets

(58) Field of Classification Search
USPC ..... 72/324–341
See application file for complete search history.

(56) References Cited

U.S. PATENT DOCUMENTS

| | | | | |
|---|---|---|---|---|
| 4,083,221 | A * | 4/1978 | Whitted | B21D 5/01 72/339 |
| 4,292,718 | A * | 10/1981 | Iijima | F16C 17/02 29/414 |
| 4,660,401 | A * | 4/1987 | Kohama | B21D 53/10 29/898.057 |
| 5,211,096 | A * | 5/1993 | Steidinger | B26D 7/2614 83/346 |
| 5,458,717 | A * | 10/1995 | Kurita | B21D 28/16 156/250 |
| 5,784,938 | A * | 7/1998 | Watkins | G03B 17/26 100/264 |
| 5,891,521 | A | 4/1999 | Marumoto et al. | |
| 6,244,151 | B1 * | 6/2001 | Machamer | B26D 7/2628 83/663 |
| 6,503,639 | B1 * | 1/2003 | Iwaya | B21D 25/02 428/167 |
| 6,966,208 | B1 * | 11/2005 | Collins | B23D 31/002 72/47 |
| 7,162,906 | B2 * | 1/2007 | Van Dalen | H01L 21/4842 140/105 |
| 7,171,884 | B2 * | 2/2007 | De Torre | B26D 1/0006 83/501 |
| 7,197,970 | B2 * | 4/2007 | Golovashchenko | B23D 15/04 83/167 |
| 7,353,738 | B2 * | 4/2008 | Chen | B26D 1/06 83/556 |
| 7,430,951 | B1 * | 10/2008 | Li | B23D 15/08 83/684 |
| 8,919,169 | B2 * | 12/2014 | Smith | B32B 15/01 72/331 |
| 9,039,855 | B2 * | 5/2015 | Schneider | A61F 13/15593 156/161 |
| 2006/0196331 | A1 * | 9/2006 | McGuigan | B26D 3/085 83/55 |
| 2007/0234859 | A1 | 10/2007 | Winkler et al. | |
| 2009/0126182 | A1 | 5/2009 | Hayashi et al. | |
| 2010/0122562 | A1 | 5/2010 | Schwoerer et al. | |
| 2010/0285333 | A1 * | 11/2010 | Kwak | C23C 28/021 428/659 |
| 2011/0011230 | A1 * | 1/2011 | Bergander | B26F 1/10 83/347 |
| 2011/0041989 | A1 | 2/2011 | Anspach et al. | |
| 2012/0012632 | A1 * | 1/2012 | Tominaga | C03B 33/04 225/2 |
| 2012/0121862 | A1 * | 5/2012 | Durney | B21D 11/20 428/156 |
| 2012/0198981 | A1 * | 8/2012 | Sofue | B26F 3/002 83/862 |
| 2013/0014625 | A1 * | 1/2013 | Yotsumoto | H01M 4/0435 83/202 |
| 2013/0019732 | A1 * | 1/2013 | Yotsumoto | B26F 1/384 83/331 |
| 2013/0071596 | A1 * | 3/2013 | Horiuchi | B26D 3/08 428/40.1 |
| 2013/0252072 | A1 * | 9/2013 | Min | B23D 33/02 429/156 |
| 2015/0033796 | A1 * | 2/2015 | Collins | C03B 23/203 65/55 |
| 2015/0197024 | A1 * | 7/2015 | Thwing | B26D 3/14 83/875 |
| 2015/0372571 | A1 * | 12/2015 | Hashimoto | H02K 15/03 156/264 |
| 2016/0023425 | A1 * | 1/2016 | Chirol | B32B 5/26 428/137 |
| 2016/0067931 | A1 * | 3/2016 | Yang | B29C 33/3842 428/156 |
| 2016/0243606 | A1 * | 8/2016 | Takahashi | B21D 28/34 |
| 2017/0120319 | A1 * | 5/2017 | Cheung | B21D 28/26 |
| 2017/0164749 | A1 * | 6/2017 | Chen | B21D 28/32 |
| 2018/0036785 | A1 * | 2/2018 | Masai | B21D 28/26 |
| 2018/0200773 | A1 * | 7/2018 | Nishijima | B21K 23/00 |
| 2018/0297100 | A1 * | 10/2018 | Murata | B21D 28/26 |
| 2018/0345350 | A1 * | 12/2018 | Hofstetter | B21D 28/26 |
| 2019/0039112 | A1 * | 2/2019 | Hirata | B21D 28/02 |

FOREIGN PATENT DOCUMENTS

| | | | | |
|---|---|---|---|---|
| CN | 101678471 | A | 3/2010 | |
| DE | 44 01 830 | C1 | 5/1995 | |
| DE | 102 39 452 | A1 | 3/2004 | |
| DE | 102 39 453 | A1 | 3/2004 | |
| DE | 10 2005 000 786 | A1 | 7/2006 | |
| DE | 10 2006 017 939 | A1 | 10/2007 | |
| EP | 1 043 160 | A1 | 10/2000 | |
| JP | 2000-124376 | A | 4/2000 | |
| JP | 2000-144067 | A | 5/2000 | |
| JP | 2000-301499 | A | 10/2000 | |
| JP | 2001-260107 | A | 9/2001 | |
| JP | 2006-205269 | A | 8/2006 | |
| JP | 2009-6641 | A | 1/2009 | |
| JP | 2009-178825 | A | 8/2009 | |
| JP | 2009-234016 | A | 10/2009 | |
| JP | 2009234016 | * | 10/2009 | B21D 22/04 |
| JP | 2010-255240 | A | 11/2010 | |
| JP | 2012-55997 | A | 3/2012 | |
| WO | WO 2004/011211 | A1 | 2/2004 | |

OTHER PUBLICATIONS

Chinese-language Office Action issued in counterpart Chinese Application No. 201780003897.5 dated Feb. 22, 2019 with English translation (14 pages).

International Search Report (PCT/ISA/210) issued in PCT Application No. PCT/EP2017/051872 dated May 10, 2017 with English translation (four (4) pages).

German-language Written Opinion (PCT/ISA/237) issued in PCT Application No. PCT/EP2017/051872 dated May 10, 2017 (five (5) pages).

German-language Search Report issued in counterpart German Application No. 102016201433.1 dated Jan. 19, 2017 with partial English translation (eleven (11) pages).

* cited by examiner

METHOD AND DEVICE FOR MACHINING AND/OR PRODUCING A COMPONENT AND SUCH A COMPONENT

CROSS REFERENCE TO RELATED APPLICATIONS

This application is a continuation of PCT International Application No. PCT/EP2017/051872, filed Jan. 30, 2017, which claims priority under 35 U.S.C. § 119 from German Patent Application No. 10 2016 201 433.1, filed Feb. 1, 2016, the entire disclosures of which are herein expressly incorporated by reference.

BACKGROUND AND SUMMARY OF THE INVENTION

The embodiments of the present invention relate to a method for machining and/or producing a component, which method is used in particular in the machining and/or production of a metallic sheet component or sandwich component or of a corresponding semifinished part.

The prior art has disclosed various mechanical severing methods with the aid of which a sheet-metal component can be trimmed or perforated. By way of example, DE 44 01 830 C1 describes a method in the case of which a sheet-metal part is fixed in a holder and then, during the working stroke of a cutting tool that is used, in the cutting gap between an upper blade and a lower blade, is initially plastically deformed and subsequently, after crack formation, fully severed. The disadvantage of this conventional method is that, if use is made of (functionally) surface-coated components, for example zinc-plated components, a non-coated surface, in the example a zinc-free surface, forms at the cutting edges, hole edges, hole walls, embrasures and the like as a result of the cutting process. This leads, in the example, to undesired damage of the component in the cut region, which can be at least partially eliminated only by cumbersome reworking or recoating. The non-coated cut regions and the like furthermore harbor the risk of disbonding of the surface coating still present on the surface of the component. This can cause additional component damage.

Taking this prior art as a starting point, it is an object of the embodiments of the present invention to specify a technically simple method, which is simple in terms of effort, for machining and/or producing a component, which method prevents or reduces secondary damage on the resulting component and thus ensures the high functionality and stability of the component.

According to the embodiments of the invention, this and other objects are achieved by means of a method for machining and/or producing a component in that, firstly, a component or a semifinished part is provided which has a main body with a first surface and with a first surface coating provided on the first surface, the component of semifinished part is subsequently notched on the first surface coated with the first surface coating, and then severing, perforation or trimming of the component or of the semifinished part is performed along the notch. Here, the notching is performed such that at least a part of the first surface coating which is notched in the process is maintained along the notch surfaces formed during the notching process. In other words, this means that the notching process is performed such that the first surface coating initially present on the first surface, which is to be notched, of the component or of the semifinished part is jointly recessed or pressed into the notch that is created, and said first surface coating remains present along the formed notch surfaces after the completion of the notching process.

The inventive method is applicable to all conceivable components/semifinished parts. The inventive method is suitable in particular for machining and/or producing metallic sheet components because, by means of the method according to the invention, it is furthermore possible for burr formation and flash formation to be reduced or prevented. The component to be used may furthermore be of single-layer or multi-layer construction, and may be provided for example in the form of a laminate. Furthermore, the inventive method is also usable in particular for sandwich components which comprise layers of plastic and steel, for example.

In the context of the invention, a surface coating is to be understood generally to mean a functional coating which is applied to the surface of the main body of the component/semifinished part for aesthetic reasons, for functionalization of the component/semifinished part, for protection or stability purposes, and in particular for the purposes of chemical and/or mechanical stability. The first surface coating may be of single-layer or multi-layer construction, and may be cohesively connected to the main body surface or may lie loosely on the latter. Furthermore, the first surface coating need not completely cover the first surface of the main body, but rather may be arranged in selected sections or in predefined regions.

The notching is performed at a location of the first surface of the component or of the semifinished part at which the first surface coating is present. As a result of the notching, so-called notch surfaces are formed, that is to say the surfaces that are formed as a result of the notching in the notching direction. According to the embodiments of the invention, said notch surfaces comprise at least a part of the notched first surface coating, which increases the functionality of the resulting component and the stability thereof with respect to environmental influences and chemical or mechanical action. This is the case in particular if the notch surfaces resulting from the notching are at least 40% covered, in particular at least 70% covered, by the first surface coating. It is preferable for the notch surfaces to be up to 100% covered with the first surface coating. The functionality introduced by the first surface coating is maintained in the resulting component even after the severing, perforation or trimming, specifically at least at the notched surfaces, the notch surfaces. It is rather possible, by means of the introduction of the first surface coating into the notch that is formed, and in a manner dependent on the surface coating that is used, for additional functionalities to be introduced, in one working step, into the notch and thus also into the component that is obtained after the perforation, severing or trimming. The inventive method is simple owing to a combination of standard processes, can be implemented without great technical effort, and permits the inexpensive machining and/or production of highly functional and highly stable components or semifinished parts with a short cycle time. It is furthermore possible to dispense with reworking for retroactive functionalization or sealing of the cut regions, whereby material costs and working effort can additionally be saved.

In one advantageous refinement of the inventive method, the severing, perforation or trimming of the component of the semifinished part is performed using a mechanical cutting process.

It is furthermore advantageous for the component or the semifinished part to have a second surface coating on a second surface situated opposite the first surface.

A further advantageous refinement of the inventive method characterized in that the component or the semifinished part is notched both on the first surface coated with the first surface coating and on the second surface coated with the second surface coating. In other words, the first surface coating, the main body of the component/of the semifinished part and the second surface coating form a type of layered structure, in which the main body of the component/of the semifinished part is arranged between the two surface coatings. The first and the second surface coating may be of identical form or may differ in terms of type, form, design and/or functionality. By means of the notching process on both sides, a subsequent severing, perforation or trimming process with improved cut quality can be facilitated, and the first and/or second surface coating can be provided along a particularly large region of the notch surfaces and thus also in the immediate vicinity of the cut region or hole region that is formed, that is to say at hole margins, hole edges, embrasures, cut edges, cut surfaces and the like. The functionalization of the component produced is thus maximized.

The notching on the first surface coated with the first surface coating can be performed to the desired notch depth. If notching is performed only from the side of the first surface coating, then a notch depth in particular of up to 90% of the thickness of the main body, but in particular of at least 80% of the thickness of the main body, can be implemented. The thickness of the main body is in this case determined in the intended notching direction, that is to say in the direction in which the notching process is to be performed or has been performed.

To provide particularly good functionalization in the component produced, it is provided in a further advantageous refinement that the notching on the first surface coated with the first surface coating and/or on the second surface coated with the second surface coating is performed in each case to a depth of less than half of the thickness of the main body of the component/semifinished part, in particular to a depth of 10 to 40% of the thickness of the main body. The thickness of the main body is in this case determined in the intended notching direction, that is to say in the direction in which the notching process is to be performed. By contrast, notching on both sides to a depth of in each case 50% of the thickness of the main body has proven to be rather disadvantageous, because the notch tips of the oppositely formed notches thus coincide.

To further improve the cut quality, it is furthermore advantageously the case that the notching is performed symmetrically in the notching direction, for example in cylindrical, conical or V-shaped fashion. In other words, this means that the shape of the notch is of symmetrical form.

To further reduce the technical effort and/or cost outlay involved in the inventive method, the notching is advantageously performed by means of stamping, roll-stamping, rolling or knurling. The methods mentioned here are particularly highly suitable for configuring the notching process such that the first and/or second surface coating is formed, or remains situated, on the corresponding notch surfaces.

To promote burr-free severing, perforation or trimming, it is furthermore advantageously provided that the notching is performed symmetrically on the first surface coated with the first surface coating and on the second surface coated with the second surface coating. Here, symmetrical refers to a configuration with the same notch shape and also the same notch depth.

As already described, the surface coating, and thus both the first surface coating and the second surface coating, is not restricted in terms of detail. The surface coating(s) is or are advantageously selected from at least one zinc layer, at least one zinc-aluminum layer, at least one adhesive layer and/or at least one polymer layer.

Further advantageous coatings are for example CDC (cathodic tip coating) layers and paints, for example in the case of the method being used on already fully coated components/semifinished parts (white goods).

Here, layers composed of zinc are advantageous for improving the corrosion resistance of the component or of the semifinished part. Owing to the inventive method, this corrosion resistance then extends to the notch surfaces and, owing to the remote effect of the zinc, also to the cut surfaces, cut edges, hole edges, embrasures and the like which remain, after the severing, perforation or trimming of the component or of the semifinished part, on the useful component that is formed. Here, it has been found that at least 40%, in particular at least 70% coverage of the notch surfaces with zinc is sufficient, owing to the remote effect of the zinc, to ensure a high level of corrosion protection in the resulting component/semifinished part.

By contrast, adhesive layers are suitable for introducing a further functionality to the notch surfaces and thus also to the cut regions, that is to say the cut surfaces, cut edges, hole edges, hole margins, embrasures and the like. This is advantageous in particular if it is the intention for a further component/semifinished part to be connected by means of adhesive forces to the regions formed during the severing process, cutting process or perforation process. Here, the inventive method eliminates a complex additional step of the retroactive introduction of an adhesive into the notch and cut region.

Furthermore, the corresponding surface coating may also comprise at least one polymer layer. Examples here are paint layers, that is to say protective paints, colored paints, corrosion protection paints and the like. The respective functionality is, by means of the notching in the inventive method, extended to the notch surfaces and also to the cut regions. The component formed is distinguished by high stability and functionality.

A thickness of the main body of the component/of the semifinished part advantageously amounts to at most 3 mm and in particular 0.5 to 2.5 mm. In this way, good spreading of the surface coating(s) onto the corresponding notch(es) can be ensured.

It is furthermore advantageous for a layer thickness of the first surface coating and/or of the second surface coating on the respective surface of the component/semifinished part to amount to at most 20 μm and in particular at most 15 μm. The layer thickness of the respective surface coating is determined perpendicular to the corresponding surface of the component/semifinished part, and can be determined on the basis of photomicrographs. If the layer thickness of the surface coating(s) lies in the stated range, sufficient surface coating is available for covering the notch, and furthermore, at most such a quantity of surface coating is available that the severing process, perforation process or trimming process can be performed in a particularly exact manner.

In a further advantageous refinement of the inventive method, the notching is performed such that a layer thickness of the first surface coating along the notch surfaces amounts to at least 20%, in particular at least 30%, of the layer thickness of the first surface coating on the first surface of the component/semifinished part. At the same time, or alternatively, the notching is performed such that a layer thickness of the second surface coating along the notch surfaces amounts to at least 20%, in particular at least 30%, of the layer thickness of the second surface coating on the second surface of the component/semifinished part. The layer thickness of the respective surface coating along the notch surfaces is determined perpendicular to the corresponding notch surface. In this way, it can be ensured in a particularly effective manner that the functionality introduced by the respective surface coating is also obtained to a particularly high degree on the notch surfaces and thus on the cut surfaces, cut edges, hole edges, embrasures and the like.

It is furthermore advantageously provided that the notching is performed such that the layer thickness of the first surface coating along the notch surfaces and/or the layer thickness of the second surface coating along the notch surfaces describe a gradient. In particular, the layer thickness of the surface coating of the surface of the component/semifinished part decreases in uniform stepped fashion along the notching direction, such that, with minimum outlay of surface coating material, maximum functionalization in the resulting component/semifinished part can be achieved.

A further advantageous refinement of the inventive method provides that the notching of the component or of the semifinished part on the first surface coated with the first surface coating and/or on the second surface coated with the second surface coating is performed in the same process step as the severing, perforation or trimming of the component or of the semifinished part along the notch. This reduces the number of process steps and thus simplifies the method according to the invention. In the case of components or semifinished parts composed of carbon-fiber composite (CFC) plastics, the notching may for example be performed already in the shaping step by means of corresponding design of the shaping tool. In the case of components or semifinished parts composed of metallic sheet, the notch may be stamped in for example in the drawing tool.

Likewise also described according to the embodiments of the invention is a component produced in accordance with the method disclosed above. The component is distinguished by high functionality and stability.

The component is advantageously distinguished by the fact that at least a part of the first surface coating and/or of the second surface coating is maintained along notch surfaces.

Also disclosed is a device for carrying out the method described above.

In particular, the device is formed such that the notching and the severing, perforation or trimming of the component or of the semifinished part can be performed in one working step. By way of example, a device in the form of a perforating tool is provided, which is designed such that the notching can be performed by a hold-down means and a cutting die, and the perforation itself can be performed by means of a perforating punch, in a single pressing stroke.

Other objects, advantages and novel features of the embodiments of the present invention will become apparent from the following detailed description of one or more preferred embodiments when considered in conjunction with the accompanying drawings, in which:

The embodiments of the present invention will be discussed in detail on the basis of exemplary embodiments. The figures illustrate only those aspects of the inventive method which are of interest here; all other aspects have been omitted for the sake of clarity. Furthermore, the same reference designations are used to denote identical elements.

DETAILED DESCRIPTION OF THE DRAWINGS

Figure 1:
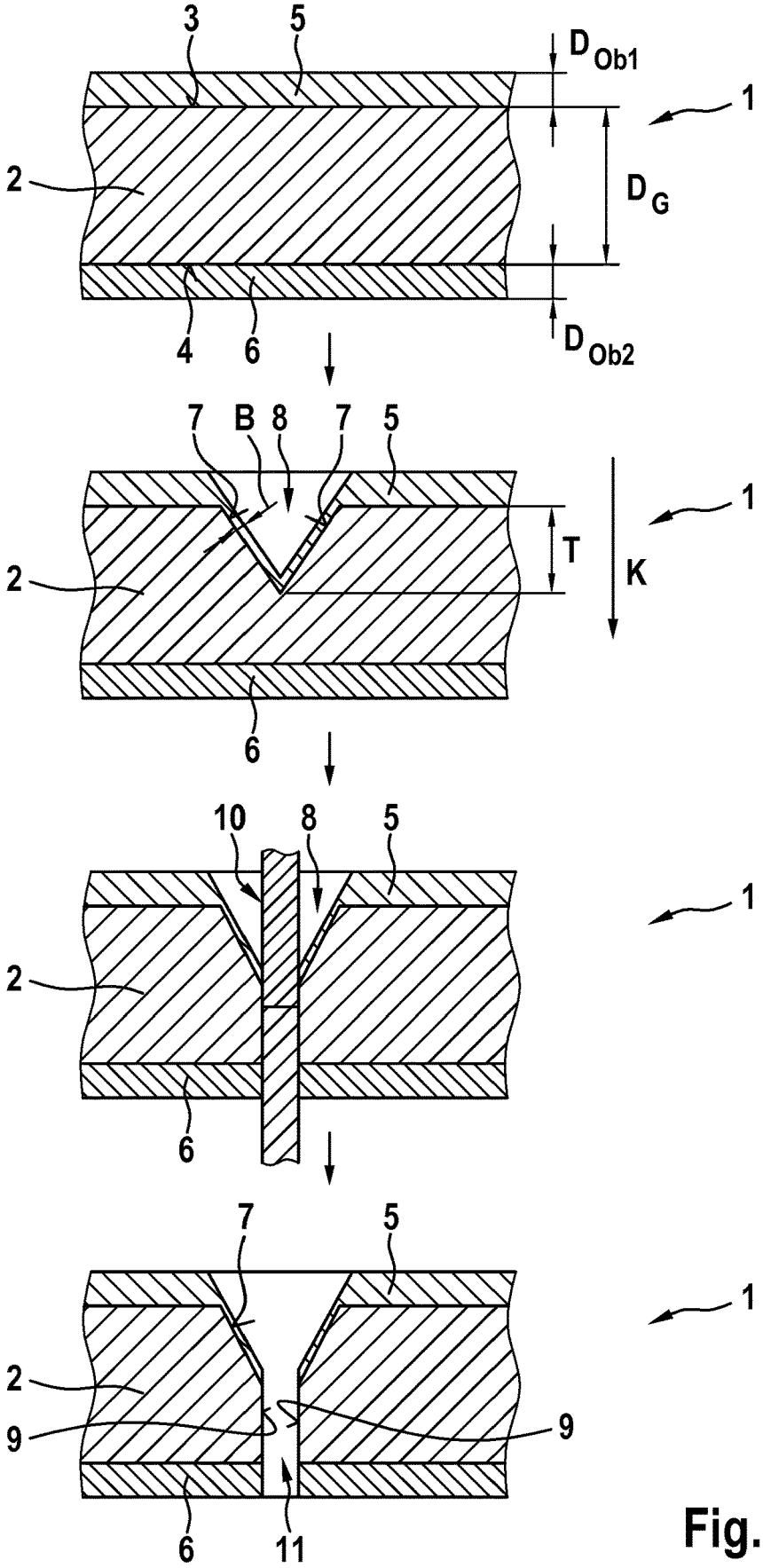
FIG. 1 shows a diagram of a sequence of a method for machining and/or producing a component.

FIG. 1 is a schematic illustration showing the method sequence of a method for machining and/or producing a component. It should be noted here that the method is basically suitable for machining or producing both semifinished parts and components. In the exemplary embodiments illustrated in the figures, however, reference will only be made to the production or machining of a component. Analogous statements however also apply to the machining or production of semifinished parts.

A component 1 is firstly provided. The component 1 is not restricted in terms of detail, and may for example be a sheet-metal component or a sandwich component. The component 1 comprises a main body 2. The main body 2 may be of single-layer or multi-layer construction. As illustrated in FIG. 1, the main body 2 is formed for example from a layer which is in particular a metal sheet with a thickness $D_G$ of up to 3 mm.

The main body 2 has a first surface 3 and a second surface 4 situated opposite the first surface 3. A first surface coating 5 is provided on the first surface 3 and a second surface coating 6 is provided on the second surface 4.

The surface coatings 5, 6 may be identical or different, that is to say may be of identical or different type and form, may lie loosely on the respective surface 3, 4, or may be cohesively connected to the corresponding surface 3, 4. Exemplary surface coatings comprise at least one zinc layer, at least one zinc-aluminum layer, at least one adhesive layer and/or at least one polymer layer.

In the present example, the first surface coating 5 and the second surface coating 6 fully cover the corresponding first surface 3 and second surface 4. It is however also possible for the surface coating 5, 6 to be provided only in particular partial sections of the respective surface 3, 4, that is to say where the notching is to be performed. The first surface coating 5 has a layer thickness denoted by $D_{Ob1}$ on the first surface 3 of the component 1. Said layer thickness is determined perpendicular to the first surface 3 of the component 1. The second surface coating 6 has a layer thickness denoted by $D_{Ob2}$ on the second surface 4 of the component 1. Said layer thickness is determined perpendicular to the second surface 4 of the component 1. The layer thickness may be determined on the basis of photomicrographs.

In a following method step, notching of the component 1 is performed on the first surface 3, coated with the first surface coating 5, so as to obtain a notch 8. The notching may be performed by means of a suitable tool, in particular by means of a stamping tool. Stamping tools are particularly highly suitable for maintaining, during the notching process, at least a part of the first surface coating 5, which is notched in the process, along the notch surfaces 7 that form. In other words, not only a region of the main body 1 but likewise the first surface coating 5 situated thereon is recessed during the notching process. The first surface coating 5 may in particular also be pressed into the notch 8. It is possible here that, as a result of the notching, the layer thickness of the first surface coating $D_{Ob1}$, which is determined perpendicular to the first surface 3 of the component 1, is compressed. This has the result that a layer thickness of the first surface coating along the notch surfaces B is smaller than the layer thickness of the surface coating $D_{Ob1}$ on the first surface 3 of the component 1. The layer thickness of the first surface coating along the notch surfaces B is determined perpendicular to the corresponding notch surfaces.

The layer thickness of the first surface coating $D_{Ob1}$ on the first surface 3 of the component 1 advantageously amounts to at most 20 μm, and is in particular at most 15 μm. In particular, the notching is performed such that the layer thickness of the first surface coating along the notch surfaces B amounts to at least 20% and in particular at least 30% of the layer thickness of the first surface coating on the first surface of the component $D_{Ob1}$. This is shown in the present example. It is furthermore possible for the layer thickness of the first surface coating along the notch surfaces B to describe a gradient, and for example to decrease in the notching direction K.

As shown by way of example in FIG. 1, the notching is performed symmetrically in the notching direction K, which is illustrated in the sectional view by the V-shape of the notch 8.

If the notching is performed from one side of the component 1, as shown here, then it is preferable for the notch depth to be as great as possible. The notch depth, which is determined in the notching direction, may extend to a depth of less than half of the thickness of the main body $D_G$, but may in particular extend to a depth of 90% of the thickness of the main body 1 $D_G$.

In a subsequent step, severing, perforation or trimming of the component is performed, for example by means of a mechanical cutting tool 10, along the notch 8 and for example in the notching direction K in FIG. 1. As a cutting tool 10, use may be made of all possible mechanical cutting tools, for example a rotary cutting tool, a shearing cutting tool, a notch fracture cutting tool, punching tool or guillotine blade, which permits severing, perforation or trimming of the component 1 with the desired shape. In the example illustrated here, a punching tool is used to produce a cylindrical aperture in the component 1. The resulting component 1 has the first surface coating 5 over a large partial region of the punched hole 11. Only in a small section of the punched hole are the surfaces of the main body 9 exposed. The function introduced by the first surface coating 5 is thus maintained even in the resulting component 1, and can even be extended to the cut regions in the component 1. Retroactive sealing or cumbersome reworking in order to increase the protective action of the component 1 or for aesthetic purposes or stability purposes is not necessary. Furthermore, depending on the first surface coating 5 used, it is also possible for additional functionality to be introduced into the notch 8 and thus also into the component obtained after the severing process. This would be the case for example if the first surface coating 5 were for example an adhesive coating. The adhesive characteristics would also be present on the notch surfaces 7 after the cutting process. Alternative functional coatings are colored paints, protective paints and the like. The method can be carried out without great technical effort, and permits the inexpensive production of highly functional and highly stable components with a short cycle time.

Figure 2:
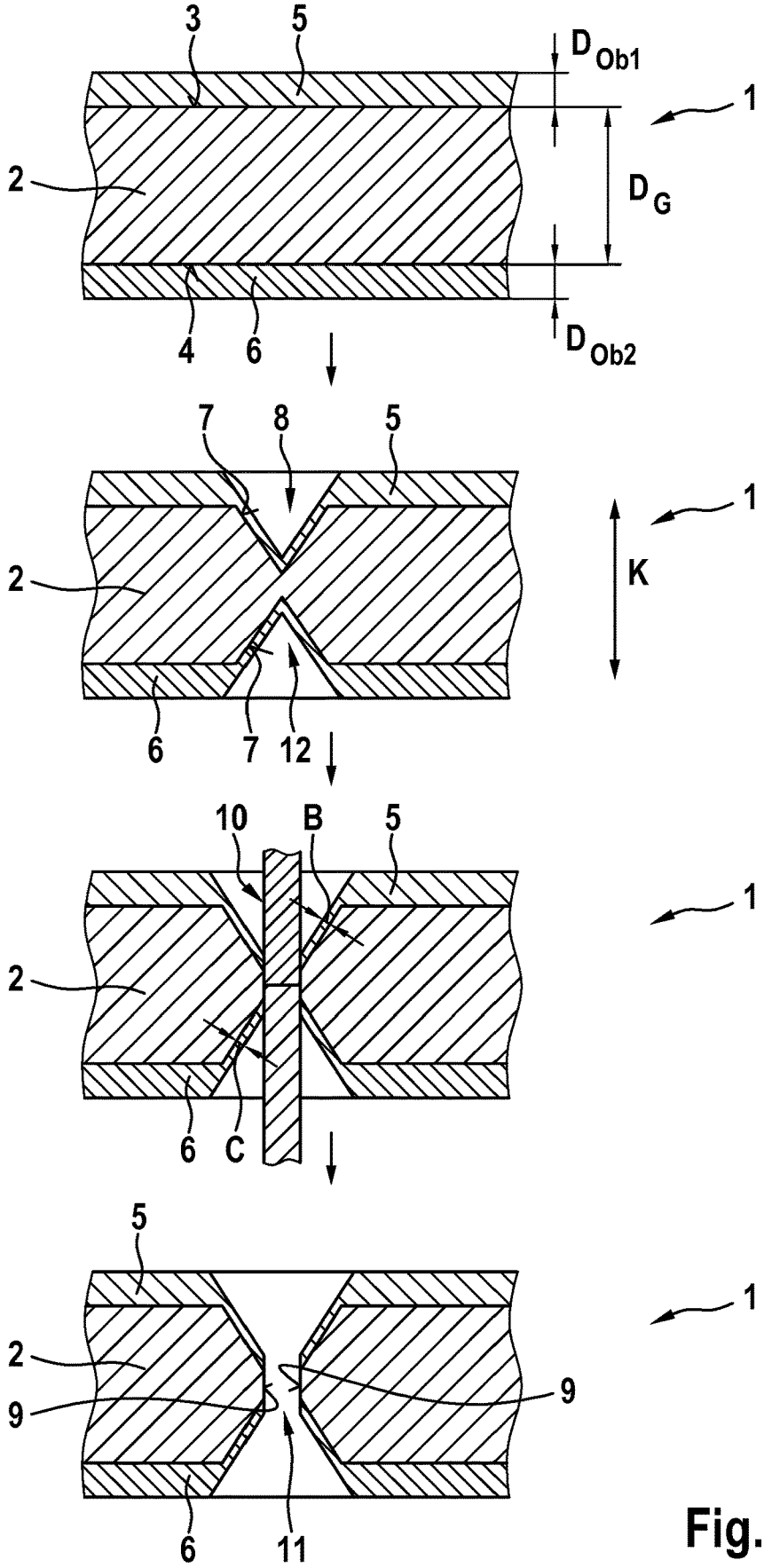
FIG. 2 shows a diagram of a sequence of a method for machining and/or producing a component.

FIG. 2 is a schematic illustration showing the method sequence of a method for machining and/or producing a component.

By contrast to the method illustrated in FIG. 1, the method illustrated in FIG. 2 differs in that notching is performed both on the first surface 3 coated with the first surface coating 5 and on the second surface 4 coated with the second surface coating 6, that is to say from oppositely situated sides of the component 1. The notches 8 and 12 are formed.

The notching on the first surface 3 coated with the first surface coating 5 and on the second surface 4 coated with the second surface coating 6 is performed to a depth of in each case less than half of the thickness of the main body $D_G$, in particular to a depth of 10 to 40% of the thickness of the main body $D_G$. The notch tips that are formed are thus prevented from coinciding. The greater the depth to which the notch 8, 12 is formed, the larger the regions of the notch surfaces 7 that are covered with the respective surface coating 5, 6.

The notching on the first surface 3 coated with the first surface coating 5 and on the second surface 4 coated with the second surface coating 6 is performed symmetrically. Thus, the notches 8 and 12 are of identical form in terms of shape and notch depth. In this way, the first surface coating 5 and the second surface coating 6 are introduced into the notch surfaces 7 of the respective notches 8, 12 and thus functionalize the notch surfaces 7 proceeding from both surfaces 3, 4 of the component 1. It is thus made more easily possible to functionalize as large a notch surface region as possible.

In turn, during the notching process, not only a region of the main body 1 but likewise the first surface coating 5 and the second surface coating 6 situated thereon are recessed. It is furthermore possible here that, as a result of the notching, the layer thickness of the first surface coating $D_{Ob1}$, which is determined perpendicular to the first surface 3 of the component 1, and the layer thickness of the second surface coating $D_{Ob2}$, which is determined perpendicular to the second surface 4 of the component 1, are compressed. This has the result that a layer thickness of the first surface coating along the notch surfaces B is smaller than the layer thickness of the first surface coating $D_{Ob1}$ on the first surface 3 of the component 1. Likewise, a layer thickness of the second surface coating along the notch surfaces C is smaller than the layer thickness of the second surface coating $D_{Ob2}$ on the second surface 4 of the component 1. The layer thicknesses of the first and second surface coatings along the notch surfaces B, C are determined perpendicular to the notch surfaces 7.

It is also the case in the method illustrated in FIG. 2 that a component 1 with high functionality and chemical and mechanical stability is obtained, which eliminates the need for resealing or reworking of the cut regions after the severing process.

The above description of the embodiments of the present invention serves merely for illustrative purposes and not for the purposes of restricting the invention. Various alterations and modifications are possible in the context of the invention without departing from the scope of the invention and of its equivalents.

The foregoing disclosure has been set forth merely to illustrate the embodiments of the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE DESIGNATIONS

1 Component
2 Main body of the component
3 First surface of the component

4 Second surface of the component
5 First surface coating
6 Second surface coating
7 Notch surface
8 Notch
9 Exposed surface of the main body
10 Cutting tool
11 Punched hole
12 Notch
B Layer thickness of the first surface coating along the notch surfaces
C Layer thickness of the second surface coating along the notch surfaces
DG Thickness of the main body
DOb1 Thickness of the first surface coating on the first surface
DOb2 Thickness of the first surface coating on the first surface
K Notching direction

What is claimed is:

1. A method for machining and/or producing a component, comprising:

providing a component or a semifinished part which has a main body with a first surface and with a first surface coating provided on the first surface, notching the component or the semifinished part on the first surface coated with the first surface coating, wherein after the notching has been completed the first surface coating remains present at least at a vertex of the notched first surface, and perforating the component or the semifinished part along the notch.

2. The method as claimed in claim 1, wherein after the notching has been completed the first surface coating remains as a continuous uninterrupted layer from a first end that is upstream of an area where the notching took place, through the area where the notching took place, to a second end that is downstream of the area where nothing took place.

3. The method as claimed in claim 1, wherein the perforating the component or of the semifinished part is performed using a mechanical cutting process.

4. The method as claimed in claim 3, wherein the component or the semifinished part has a second surface coating on a second surface situated opposite the first surface, and the component or the semifinished part is notched both on the first surface coated with the first surface coating and on the second surface coated with the second surface coating.

5. The method as claimed in claim 4, wherein the notching on the first surface coated with the first surface coating and/or on the second surface coated with the second surface coating is performed to a depth of less than half of the thickness of the main body DG.

6. The method as claimed in claim 5, wherein the notching is performed symmetrically in a notching direction.

7. The method as claimed in claim 6, wherein the notching is performed by means of stamping, roll-stamping, rolling or knurling.

8. The method as claimed in claim 7, wherein the notching is performed symmetrically on the first surface coated with the first surface coating and on the second surface coated with the second surface coating.

9. The method as claimed in claim 8, wherein the first and/or second surface coating is selected from at least one zinc layer, at least one zinc-aluminum layer, at least one adhesive layer and/or at least one polymer layer.

10. The method as claimed in claim 9, wherein a thickness of the main body (DG) amounts to at most 3 mm.

11. The method as claimed in claim 10, wherein a layer thickness of the first surface coating (DOb1) and/or a layer thickness of the second surface coating (DOb2) amounts to at most 20 μm.

12. The method as claimed in claim 11, wherein a layer thickness of the second surface coating along the notch surfaces amounts to between at least 20% and at least 30%, of the layer thickness of the second surface coating on a second surface of the component (DOb2) or of the semifinished part.

13. The method as claimed in claim 12, wherein the layer thickness of the first surface coating along the notch surfaces and/or the layer thickness of the second surface coating along the notch surfaces defines a gradient.

14. A device for carrying out the method as claimed in claim 13.

15. The device as claimed in claim 14, wherein the device is configured to perform at least one of the notching, severing, perforation, or trimming of the component or of the semifinished part in one working step.

16. The method as claimed in claim 4, wherein the notching on the first surface coated with the first surface coating and/or on the second surface coated with the second surface coating is performed to a depth of 10 to 40% of the thickness of the main body DG.

17. The method as claimed in claim 9, wherein a thickness of the main body (DG) amounts to between 0.5 and 2.5 mm.

18. The method as claimed in claim 10, wherein a layer thickness of the first surface coating (DOb1) and/or a layer thickness of the second surface coating (DOb2) amounts to at most 15 μm.

19. A component produced in accordance with a method as claimed in claim 1.

20. The component as claimed in claim 19, wherein at least a part of the first surface coating or of the second surface coating is maintained along notch surfaces.

21. The method as claimed in claim 1, wherein a layer thickness of the first surface coating along the notch surfaces amounts to between at least 20% and at least 30%, of the layer thickness of the first surface coating on a first surface of the component (DOb1) or of the semifinished part.

* * * * *